US006703943B1

(12) United States Patent
Lalla et al.

(10) Patent No.: US 6,703,943 B1
(45) Date of Patent: Mar. 9, 2004

(54) ASSEMBLY FOR SIGNAL TRANSFER BETWEEN A RECEIVING STATION AND A TRANSMITTING STATION AS WELL AS FOR POWER SUPPLY OF THE TRANSMITTING STATION

(76) Inventors: Robert Lalla, Alemannenweg 6, D-79541 Lörrach (DE); Ronald Schreiber, Rabenauer Str. 27, D-01159 Dresden (DE)

( * ) Notice: Subject to any disclaimer, the term of this patent is extended or adjusted under 35 U.S.C. 154(b) by 0 days.

(21) Appl. No.: 09/387,998

(22) Filed: Sep. 1, 1999

(30) Foreign Application Priority Data

Sep. 7, 1998 (EP) ..... 98116881

(51) Int. Cl.[7] ..... G08C 17/00
(52) U.S. Cl. ..... 340/870.39; 307/110; 340/870.34
(58) Field of Search ..... 307/110, 870.36, 307/506, 511, 537, 870.18, 870.37, 870.3

(56) References Cited

U.S. PATENT DOCUMENTS

| | | | | |
|---|---|---|---|---|
| 5,187,474 A | | 2/1993 | Kielb et al. | 340/870.18 |
| 5,451,923 A | | 9/1995 | Seberger et al. | 340/870.18 |
| 5,684,451 A | | 11/1997 | Seberger et al. | 340/870.18 |
| 5,742,225 A | * | 4/1998 | Wetzel et al. | 340/310.01 |
| 6,064,582 A | * | 5/2000 | Luchner et al. | 307/110 |

FOREIGN PATENT DOCUMENTS

| | | |
|---|---|---|
| DE | 3615463 A1 | 12/1987 |
| EP | 0 244 808 | 5/1987 |
| EP | 0 591 926 A2 | 4/1994 |
| EP | 0 744 724 B1 | 8/2001 |
| JP | 06244825 | 9/1994 |
| WO | WO 88/02528 | 4/1988 |

* cited by examiner

*Primary Examiner*—Michael Horabik
*Assistant Examiner*—Hung Dang
(74) *Attorney, Agent, or Firm*—Bose McKinney & Evans LLP

(57) ABSTRACT

In an assembly for signal transfer between a receiving station and a transmitting station and for power supply of the transmitting station where these two stations are connected via a two-wire line, an analog signal current variable between two limiting values is transmitted via this two-wire line, this signal current representing a measured value sensed by a sensor. This current also forms the supply current needed to operate the transmitting station. In the transmitting station a circuit is provided, generating a constant operating voltage for the transmitting station. The transmitting station includes a controllable current source which dictates the current flowing via the two-wire line as a function of the measured value. A charge pump is connected to the output of the current source, the charge pump generating from the voltage appearing at the output of the current source all the operating voltage needed for operating the sensor and a signal processing circuit connected thereto.

4 Claims, 5 Drawing Sheets

ASSEMBLY FOR SIGNAL TRANSFER BETWEEN A RECEIVING STATION AND A TRANSMITTING STATION AS WELL AS FOR POWER SUPPLY OF THE TRANSMITTING STATION

FIELD OF THE INVENTION

The invention relates to an assembly for signal transfer between a receiving station and a transmitting station as well as for power supply of the transmitting station.

BACKGROUND OF THE INVENTION

Known from EP-A-0 744 724 is one such circuit assembly in which the two stations are connected by a two-wire line via which an analog signal current variable between two limiting values is transmitted, this signal current representing a measured value sensed by a sensor in the transmitting station and forming the supply current needed to operate the transmitting station. In this arrangement the transmitting station comprises a circuit generating a constant operating voltage for the transmitting station, and it includes a controllable current source which dictates the current flowing via the two-wire line as a function of the measured value and which is fed from a supply voltage source in the receiving station, wherein the transmitting station "sees" at its two inputs a voltage which may vary over wide ranges depending on the selection of the supply voltage source. For transferring the measured value the transmitting station regulates its input current ideally so that it depends solely on the measured value. In this arrangement the supply of the transmitting station is made exclusively via the two-wire line, the input voltage generally being higher than the supply voltage required internally. This is why in the transmitting station the input voltage is stepped down by a linear regulator to the supply voltage required internally. This unfortunately limits the available supply current by the input current of the transmitting station, it being this limitation that restricts the flexibility as regards use of sensors and signal analyzing circuits in the transmitting station, since there is a desire too, to use sensors requiring a current higher than that supplied to it via the two-wire line.

OBJECTS OF THE INVENTION

It is thus the object of the invention to provide a signal transfer and power supply assembly which as regards the sensors and signal conditioning units used in the transmitting station is highly flexible and as regards the power supply can be tailored to individual circumstances.

SUMMARY OF THE INVENTION

To achieve this object the invention provides an assembly for signal transfer between a receiving station and a transmitting station as well as for power supply of the transmitting station in which these two stations are connected to each other by a two-wire line, via which an analog signal current variable between two limiting values is transmitted, this signal current representing a measured value sensed by a sensor in the transmitting station and forming the supply current needed to operate the transmitting station. In this arrangement the transmitting station comprises a circuit generating a constant operating voltage for the transmitting station, and it includes a controllable current source which dictates the current flowing via the two-wire line as a function of the measured value and which is fed from a supply voltage source in the receiving station, the current source being a series current regulator fed from the supply voltage source in the receiving station, a charge pump being connected to the output of the current source, the charge pump generating from the voltage appearing at the output of the current source the operating voltage needed for operating the sensor and a signal processing circuit connected thereto, and a parallel regulator for maintaining the input voltage or respectively the output voltage of the charge pump constant being connected to the input and output respectively of the charge pump.

In accordance with a first aspect of the invention, on the corresponding other side of the charge pump a further parallel regulator is provided in addition to the parallel regulator at the input or output of the charge pump.

In accordance with a second aspect of the invention, on the corresponding other side of the charge pump a linear regulator is provided in addition to the parallel regulator at the input or output of the charge pump.

In one improvement the current source is bridged by a voltage regulator furnishing in a starting phase an input voltage for the charge pump, the current source being configured so that it does not furnish an output current in the starting phase until the charge pump outputs an output voltage sufficient for its operation, the voltage regulator being configured so that it changes to the OFF state as soon as the output voltage has attained the operating voltage.

In another improvement the charge pump has a voltage transfer factor <1.

By using a combination of current and voltage regulators in conjunction with a charge pump the current and voltage values needed for operating the transmitting station may be set over wide ranges so that a high flexibility is attained as regards the usable sensors. More particularly, circuit units may be put to use in the transmitting station requiring a supply current higher than the current permitted to flow as a maximum signal current via the two-wire line to the receiving station. Likewise a salient advantage of the assembly in accordance with the invention is its facilitated integratability, it containing no inductances, but instead capacitors in the main which are easy to produce integrated with capacitances <1 nF.

BRIEF DESCRIPTION OF THE DRAWINGS

Embodiments of the invention will now be detailed with respect to the drawing in which.

DESCRIPTION OF THE PREFERRED EMBODIMENTS

Figure 1:
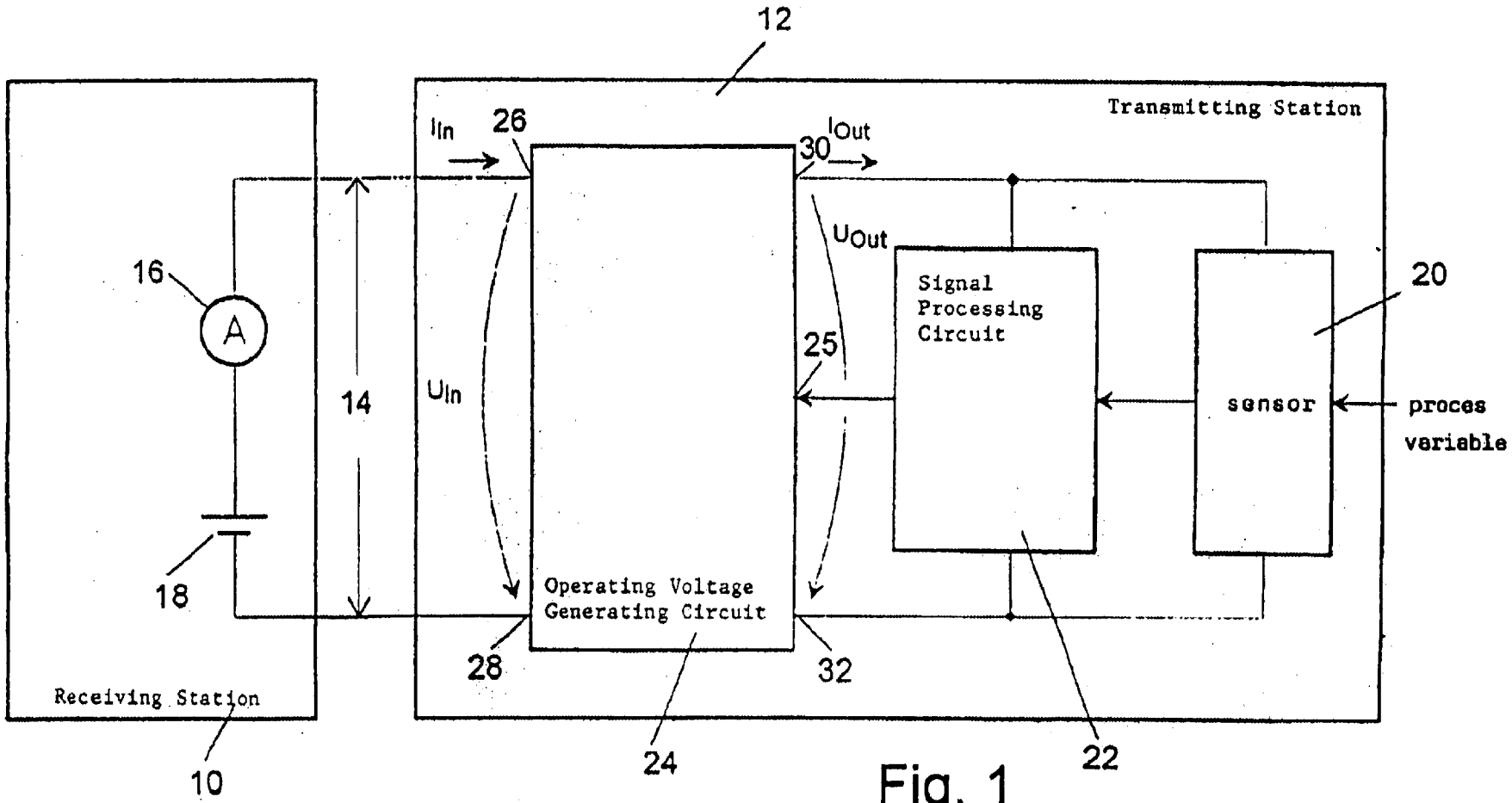
FIG. 1 is a schematic overview illustrating an assembly or signal transfer between a transmitting station and a receiving station in which the invention is applicable.

Referring now to FIG. 1, there is illustrated the assembly for signal transfer including a receiving station 10 and a transmitting station 12 connected to each other via a two-wire line 14. Provided in the receiving station 10 is a signal analyzing circuit 16 represented symbolically as an ammeter, since the current flowing via the two-wire line 14 to the receiving station 10 is the electrical parameter to be analyzed. The receiving station 10 comprises further a supply voltage source 18, i.e. the power supply required for operating the signal transfer assembly at both the receiving and the transmitting end.

The transmitting station 12 includes a sensor 20 sensing in a process a process variable, for example a temperature, a pressure, a material level or the like as the measured value. The sensor 20 sends its output signal representing the measured value to a signal processing circuit 22 which generates a control signal proportional to the measured value sensed by the sensor 20. A circuit 24 included in the transmitting station 12 generates the operating voltage needed for operation of the signal processing circuit 22 and sensor 20, it simultaneously setting the current flowing via the two-wire line 14 as controlled by the control signal supplied to its input 25 to a current value $I_{in}$ proportional to the measured value as sensed by the sensor 20. Its inputs 26 and 28 are connected to the two-wire line 14, whilst its outputs 30 and 32 at which it outputs the constant operating voltage are connected to the supply voltage terminals of the signal processing circuit 22 and sensor 20.

Figure 2:
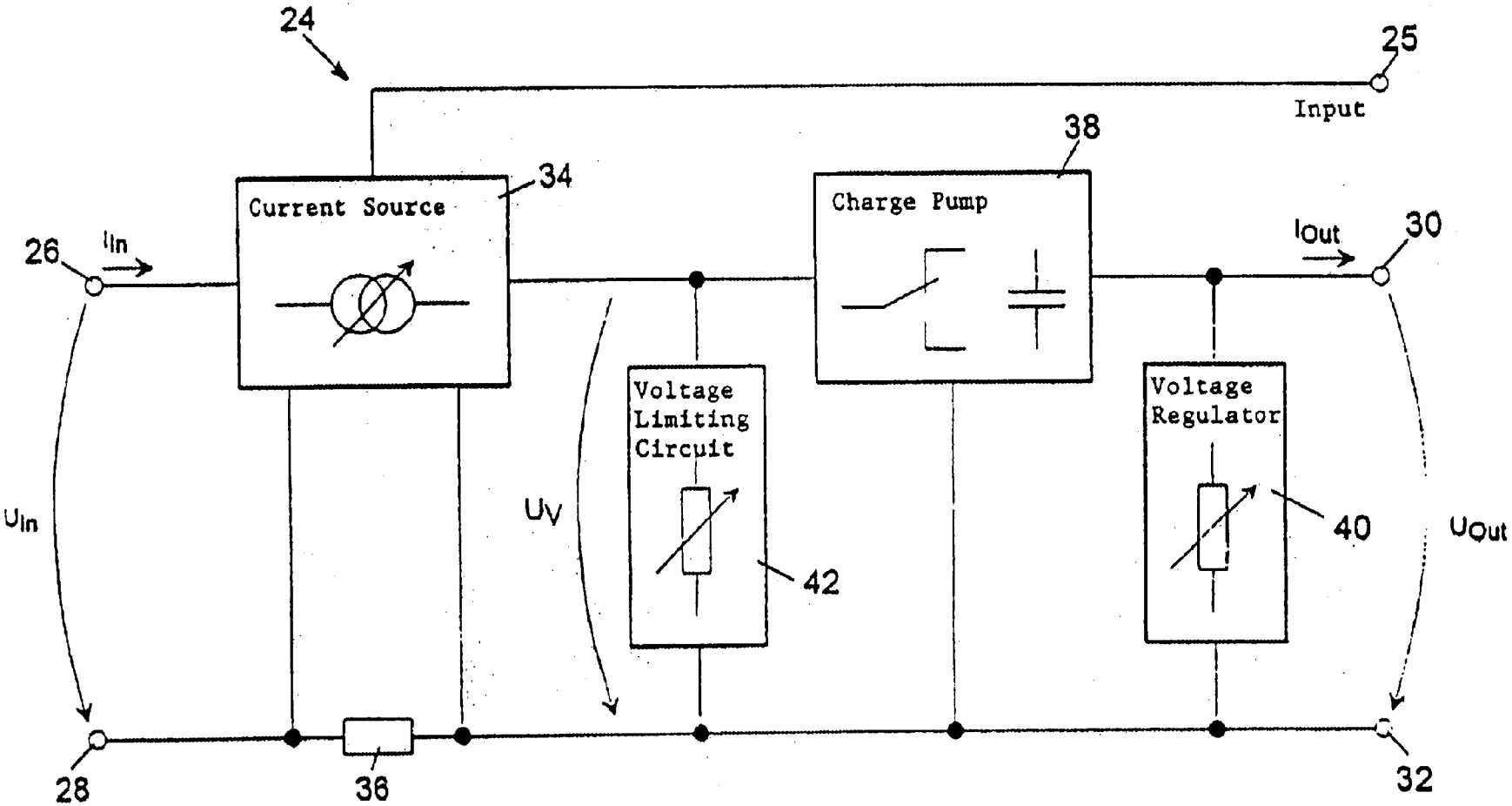
FIG. 2 is a schematic block diagram of the power supply in accordance with the invention for the assembly as shown in FIG. 1.

Referring now to FIG. 2, there is illustrated the configuration of the circuit 24 as a schematic circuit diagram. The circuit includes a current source 34 configured as series current regulator. The current set via the control signal at the input 25 is maintained constant by the series current regulator to the set value, it being the drop in voltage as tapped across a measuring resistor 36 through which the set current flows that is used as the reference variable. At the output of the series current regulator 34 a voltage $U_v$ materializes from the internal resistance of the further circuit components. This voltage serves as the supply voltage for a charge pump 38 which furnishes at its output a voltage $U_{out}$ representing the supply voltage for the signal processing circuit 22 and sensor 20. This output voltage $U_{out}$ is maintained constant by means of a voltage regulator 40 configured as a parallel regulator.

The charge pump 38 comprises conventionally a series of switches 38.1–38.4 and capacitors C1, C2, C3 as well as a control circuit 39 which controls, i.e. opens and closes the switches 38.1–38.4 so that a charge voltage appears across the capacitor C3 which corresponds to the desired output voltage. The configuration of the charge pump is illustrated only schematically in FIG. 3 and FIG. 5 since how such circuits work and are configured is known in various versions to the person skilled in the art (for example from "Halbleiterschaltungstechnik" by U. Tietze and Ch. Schenk, 1991, page 570, 571).

In case the control signal at the input 25 sets the series current regulator 34 to a current value higher than that which can be derived from the charge pump 38, this current can be derived via an additional circuit unit 42 acting as a voltage limiting circuit, the higher current furnished by the series current regulator 34 resulting namely in a higher voltage $U_v$ and the voltage limiting circuit 42 can be designed so that it responds to a predetermined voltage value being exceeded by diverting the excess current in achieving voltage limiting.

The circuit as shown in FIG. 2 permits setting current and voltage values within wide limits for the operation of the signal processing circuit 22 and sensor 20 in the transmitting station. The procedure for estimating the operating limits of the circuit as shown in FIG. 2 will now be discussed:

Due to the voltage transformation $v_U$ of the charge pump 38 it can be determined which voltage $U_v=U_{Vmin}$ is needed as a minimum so that at the output the design voltage $U_{out}=U_{outd}$ is attained:

$$U_{Vmin} = \frac{1}{v_U} \cdot U_{outd} \tag{1}$$

When the prevoltage is limited by the voltage limiting circuit 42 the voltage $U_{Vmin}$ needed as a minimum should be reliably attained:

$$U_{Vbypass} \geqq U_{Vmin} \tag{2}$$

The lower limit $U_{inmin}$ of the input voltage range materializes from the maximum possible prevoltage $U_{Vbypass}$ plus the drop in voltage $U_{ireg}$ needed to operate the current regulator 34

$$U_{inmin}=U_{Vbypass}+U_{ireg} \tag{3}$$

Assuming that no current losses occur in the series current regulator 34 and in the voltage limiting circuit 42 the current $I_{outmax}$ obtained as a maximum from the output is given by the current transformation ratio $V_I$ of the charge pump 38 and the input current $I_{in}$ depending on the sensed measured value:

$$I_{outmax}=V_I \cdot I_{in} \tag{4}$$

Usual charge pumps attain a power efficiency of practically 100%, it then applying for the transformation ratios $v_U$ and $V_I$:

$$\frac{1}{v_U} = V_I \tag{5}$$

The series current regulator 34 can be operated with the output voltage $U_{out}$, this then requiring, however, special precautions to be taken so that the circuit 24 starts and furnishes the required output voltage. For this purpose it is possible to design the series current regulator 34 so that it furnishes without its own supply voltage a possibly non-regulated current to the charge pump 38. The charge pump 38 is then able to generate an output voltage $U_{out}$, it being with this output voltage that the series current regulator 34 may then be operated.

Figure 3:
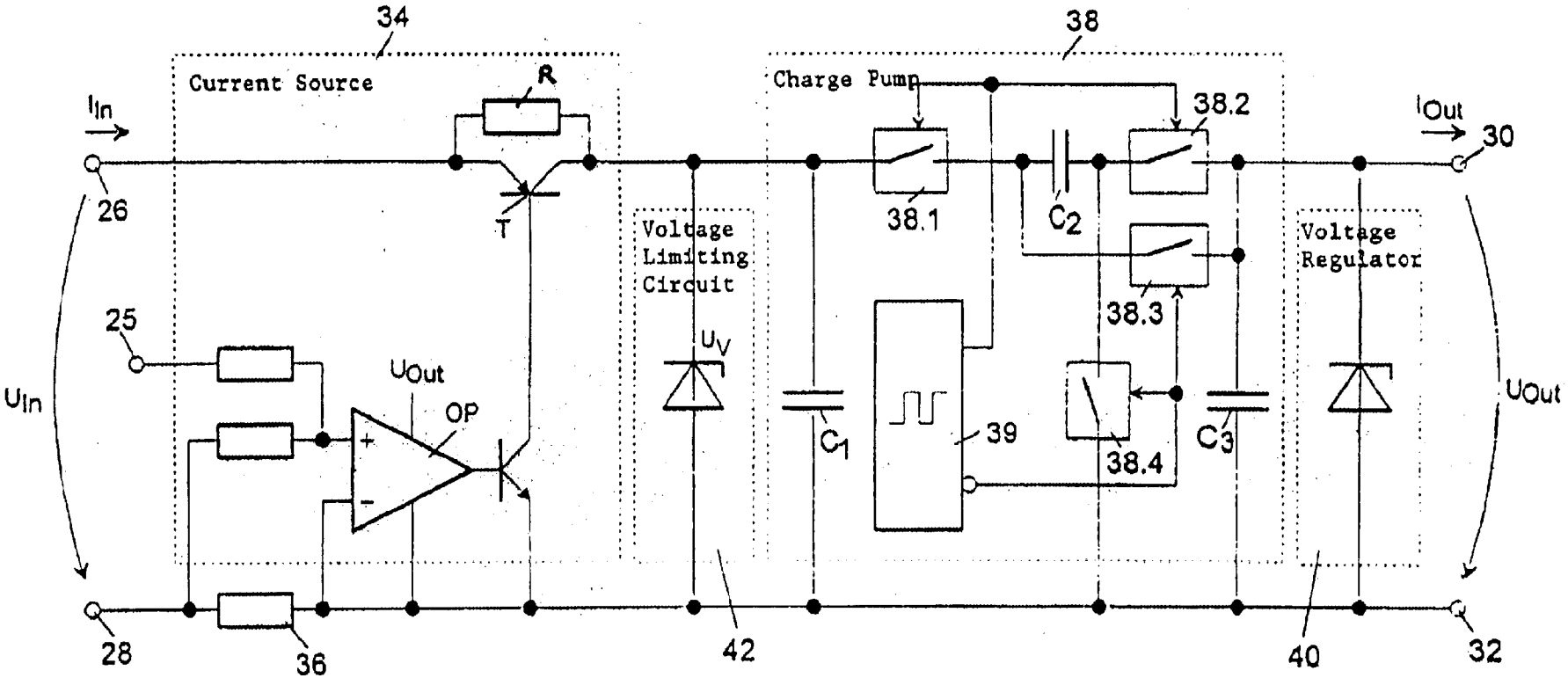
FIG. 3 is a circuit diagram of the power supply as shown in FIG. 2, the individual circuit units of which are illustrated by way of example more precisely as regards their configuration.

Referring now to FIG. 3, there is illustrated a circuit diagram showing in principle the configuration of the series current regulator 34, the voltage limiting circuit 42, the charge pump 38 and voltage regulator 40. It will be appreciated that the configuration of the various circuit units is indicated merely by way of example. It is only important for the invention how the various circuit units function and interact with the other circuit units, whereas the particular configuration is not important for the invention.

The series current regulator 34 as shown in FIG. 3 is a simple series regulator which maintains the current flowing through the transistor T constant at a value adjustable via the operational amplifier OP by means of the control signal at the input 25. The resistor R located in the current regulator 34 between emitter and collector of the transistor T has the purpose of enabling the circuit to be started. It is via this resistor R that a small current may also flow, with transistor T OFF, sufficient as the starting current for the circuit. In the simplest case the voltage limiting circuit 42 is simply a Zener diode which limits the voltage appearing at the output of the current regulator 34 to a constant value. Depending on how it is configured the charge pump is able to achieve practically any voltage and current transformation. It will be appreciated that the circuit of the charge pump as illustrated is intended merely by way of an example, the person skilled in the art being well aware of the configuration and functioning of such charge pumps from a wealth of literature references. The voltage regulator circuit 40 too, is in the simplest case simply a Zener diode which maintains the value of the output voltage $U_{out}$ constant.

Figure 4:
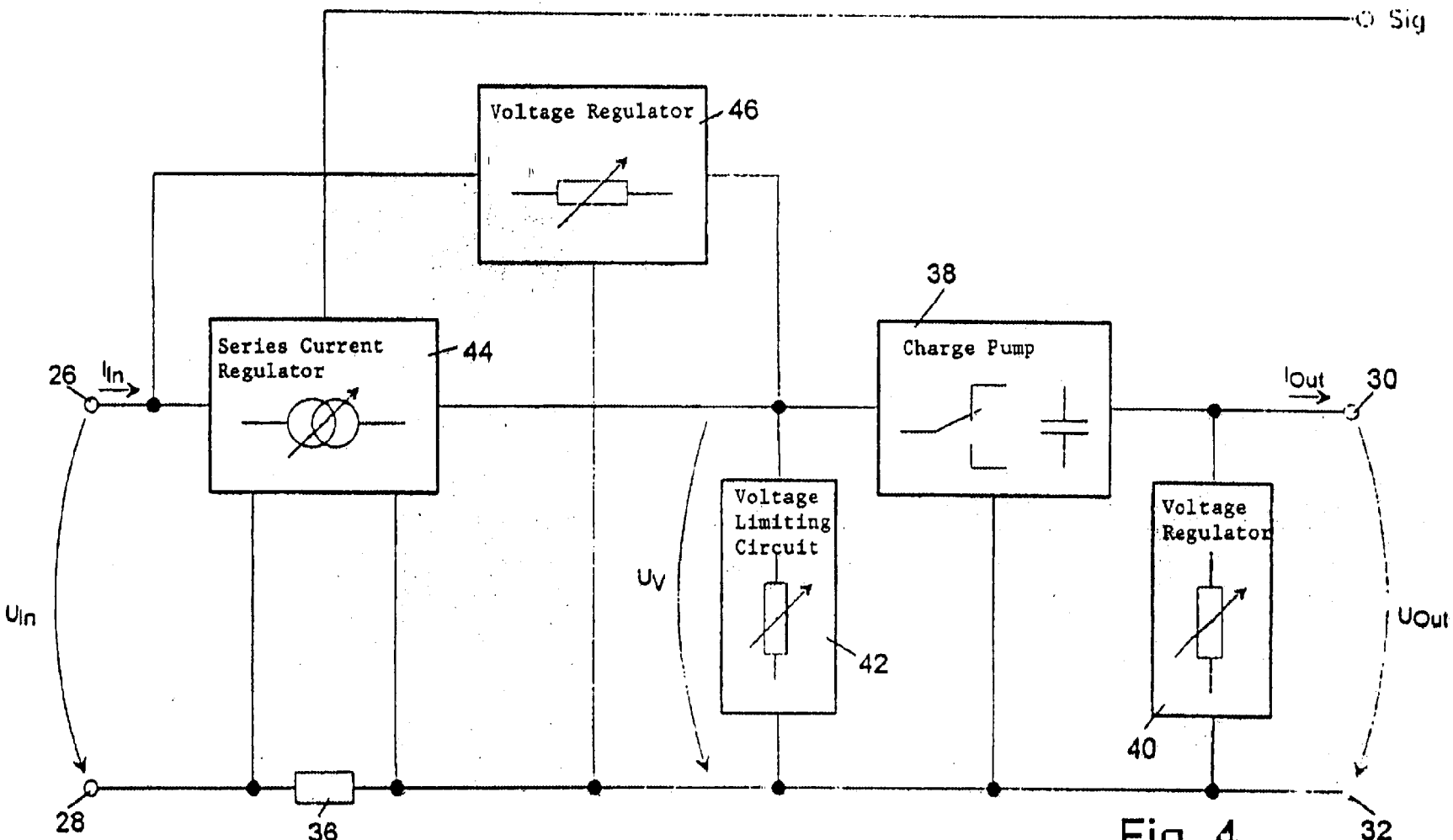
FIG. 4 is a block diagram of a second embodiment of a power supply in accordance with the invention for use in the assembly as shown in FIG. 1.

Should the series current regulator 34 be configured so that it will not work without its own supply voltage, special precautions need to be taken so that the current regulator can assume operation and furnish a current to the charge pump 38. Referring now to FIG. 4, there is illustrated a block diagram to explain how the circuit can be put into operation in such a case. This circuit includes a current regulator 44 which without its own operating voltage is firstly OFF, i.e. unable to output current to the charge pump 38. As evident from FIG. 4 the series current regulator 44 is bridged by a voltage regulator 46 which on start of operation of the circuit generates a voltage $U_{V1}$ acting as the supply voltage for the charge pump 38 so that the latter is then able to furnish at its output a voltage $U_{out}=U_{out1}$. Care must be taken to ensure that this voltage is sufficient to start operation of the series current regulator 44. As soon as the series current regulator 44 is in operation it outputs a higher current so that the voltage $U_{V1}$ increases accordingly until the limiting effect of the voltage limiting circuit 42 commences. The voltage $U_{V1}$ then has the value $U_v$. The voltage regulator 46 is designed so that as soon as the voltage value $U_v$ is attained at the output of the series current regulator 44 it is no longer effective, it instead assuming the OFF state in which it no longer bridges the current regulator 44.

Figure 5:
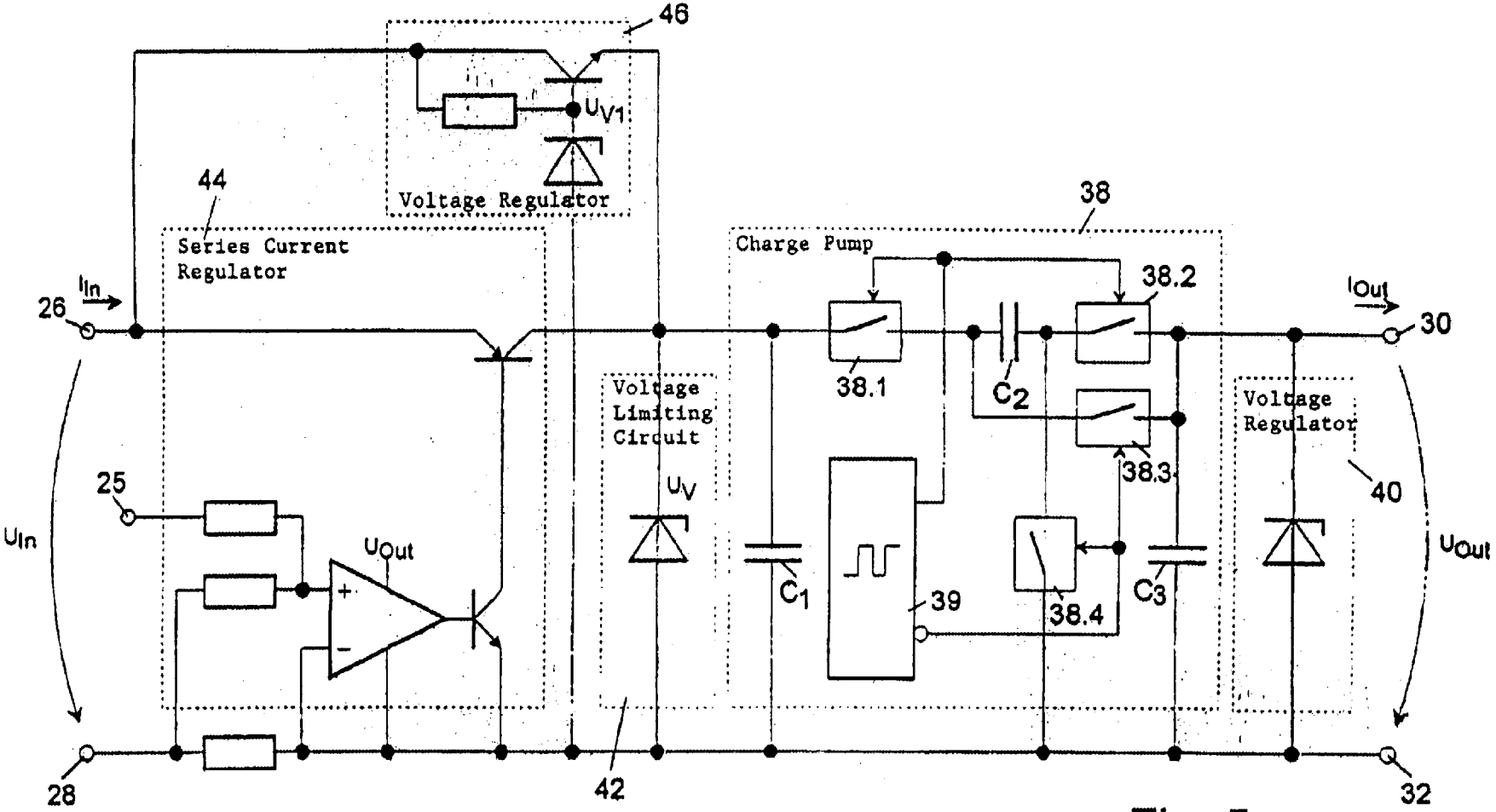
FIG. 5 is a circuit diagram of the power supply as shown in FIG. 4 the individual circuit units of which are illustrated by way of example more precisely as regards their configuration.

Referring now to FIG. 5, there is illustrated a more detailed circuit diagram indicating how the individual components of the circuit as shown in FIG. 4 may be configured, it being evident that the series current regulator 44 (except for a difference to be explained below), the voltage limiting circuit 42, the charge pump 38 and the voltage regulator circuit 40 are all configured just the same as in the circuit as shown in FIG. 3. All that has been added is the voltage regulator 46 which, as evident from the circuit diagram, is configured as a series voltage regulator. In the series current regulator 44 the transistor T is not bridged by a resistor as is the case with the series current regulator 34. This resistor is not needed since it is the voltage regulator 46 in this case that permits starting the circuit.

In the example embodiments as described, both the input voltage and the output voltage of the charge pump 38 are maintained constant, for the purpose of which at the input end the aforementioned voltage limiting circuit 42 is used which is nothing more than a parallel regulator, and indeed, also the circuit used at the output end for maintaining the output voltage of the charge pump 38 constant is a parallel regulator. However, it is also possible to do away with maintaining the input voltage of the charge pump 38 constant, simply by using a charge pump capable of working with higher input voltages or input currents. In maintaining the input voltage of the charge pump constant, having to maintain the output voltage of the charge pump constant can be done away with if a load dependency of the output voltage is tolerable. When employing two voltage regulators at the input and output of the charge pump 38 it is possible to configure one of the two regulators as a longitudinal regulator without affecting the intended effect of the circuit assembly as a whole. The charge pump as shown in FIGS. 3 and 5 has a voltage transfer factor of ½ meaning that it produces a halving of the voltage and a doubling of the current. Of course, charge pumps having other voltage transfer factors may also be put to use should other voltage and current conditions be desired. The assembly as described in the present employs a transfer factor <1 in any case since this enables a higher current to be made available at the output of the charge pump.

The circuits as shown in two embodiments in FIGS. 2 to 5 have the advantage that they may be configured as integrated circuits and that they permit furnishing the various currents and voltages as needed in the transmitting station for operating the respective sensor and the processing circuit receiving the output signal thereof by extremely flexible means. This excellent integration capability of all variants involved is to be attributed particularly to the circuits employing no inductances but instead capacitors in the main which are easy to produce integrated with capacitances <1 nF.

What is claimed is:

1. An assembly for signal transfer between a receiving station and a transmitting station as well as for power supply of said transmitting station in which these two stations are connected to each other via a two-wire line, via which an analog signal current variable between two limiting values is transmitted, this signal current representing a measured value sensed by a sensor in said transmitting station and forming the supply current needed to operate said transmitting station, said transmitting station comprising a circuit generating a constant operating voltage for said transmitting station; and a controllable current source being included in said transmitting station which dictates the current flowing via said two-wire line as a function of said measured value and which is fed from a supply voltage source in said receiving station, said current source being a series current regulator fed from said supply voltage source in said receiving station, a charge pump being connected to the output of said current source, said charge pump generating from the voltage appearing at said output of said current source the operating voltage needed for operating said sensor and a signal processing circuit connected thereto, and a parallel regulator for maintaining the input voltage or respectively the output voltage of said charge pump constant being connected to the input and output respectively of said charge pump, wherein said current source is bridged by a voltage regulator furnishing in a starting phase an input voltage ($U_{v1}$) for said charge pump, said current source being configured so that it does not furnish an output current in the starting phase until said charge pump outputs an output voltage sufficient for its operation, said voltage regulator being configured so that it changes to the OFF state as soon as said output voltage ($U_{out}$) has attained said operating voltage.

2. The assembly as set forth in claim 1, wherein on the corresponding other side of said charge pump a further parallel regulator is provided in addition to said parallel regulator at the input or output of said charge pump.

3. The assembly as set forth in claim 1, wherein on the corresponding other side of said charge pump a linear regulator is provided in addition to said parallel regulator at the input or output of said charge pump.

4. The assembly as set forth in claim 1, wherein said charge pump has a voltage transfer factor <1.

* * * * *